US008781347B2

(12) United States Patent
Kim et al.

(10) Patent No.: US 8,781,347 B2
(45) Date of Patent: Jul. 15, 2014

(54) IMAGE FORMING APPARATUS AND METHOD OF DRIVING THE SAME

(75) Inventors: Yun-su Kim, Yongin-si (KR); Dae-lim Shin, Suwon-si (KR); Hong-chul Choi, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 87 days.

(21) Appl. No.: 13/487,424

(22) Filed: Jun. 4, 2012

(65) Prior Publication Data

US 2013/0016986 A1 Jan. 17, 2013

(30) Foreign Application Priority Data

Jul. 12, 2011 (KR) ..... 10-2011-0068979

(51) Int. Cl.
*G03G 15/00* (2006.01)

(52) U.S. Cl.
USPC ..... 399/44; 399/36; 399/94

(58) Field of Classification Search
USPC ..... 399/36, 44, 70, 94, 167
See application file for complete search history.

(56) References Cited

U.S. PATENT DOCUMENTS

| | | | | |
|---|---|---|---|---|
| 7,212,762 | B2 * | 5/2007 | Watabe | 399/70 |
| 7,496,310 | B2 * | 2/2009 | Dan | 399/70 |
| 7,502,585 | B2 * | 3/2009 | Uehara et al. | 399/329 |
| 7,809,294 | B2 * | 10/2010 | Hattori et al. | 399/44 |

FOREIGN PATENT DOCUMENTS

| | | | | |
|---|---|---|---|---|
| JP | 07199371 A | * | 8/1995 | G03B 27/50 |
| JP | 2006208939 A | * | 8/2006 | G03G 21/14 |

* cited by examiner

*Primary Examiner* — David Gray
*Assistant Examiner* — Carla Therrien
(74) *Attorney, Agent, or Firm* — Stanzione & Kim, LLP

(57) ABSTRACT

An image forming apparatus and a method of driving the same are provided in which, if a driving environment is determined to be a low temperature environment, a driving load of an image forming unit is decreased by repeating driving and stopping a driving motor under a high load driving condition to generate a torque higher than a torque generated under a normal warm-up driving condition; and a warm-up operation is performed by driving the driving motor under the normal warm-up driving condition.

25 Claims, 6 Drawing Sheets

IMAGE FORMING APPARATUS AND METHOD OF DRIVING THE SAME

CROSS-REFERENCE TO RELATED APPLICATIONS

This application claims priority from and the benefit under 35 U.S.C. §119 to Korean Patent Application No. 10-2011-0068979, filed on Jul. 12, 2011, in the Korean Intellectual Property Office (KIPO), the disclosure of which is incorporated herein in its entirety by reference.

BACKGROUND

1. Field

The present general inventive concept relates to an image forming apparatus including a driving motor and a method of driving the image forming apparatus.

2. Discussion of the Background

In electrophotographic image forming apparatuses, light representing image information is radiated to a photoconductor to form an electrostatic latent image on a surface of the photoconductor, toner is supplied to the electrostatic latent image to develop the electrostatic latent image into a visible toner image, and then the visible toner image is transferred and fixed on a recording medium, thereby printing an image on the recording medium.

An image forming apparatus may include a paper feeding unit, a developing unit, a fixing unit, and one or more driving motors to drive the units. The paper feeding unit feeds a recording medium to the image forming apparatus, and the developing unit transfers an image on the recording medium by using, for example, an electrophotographic process. The fixing unit applies heat and pressure on the image transferred on the recording medium to permanently fix the image.

In order to safely drive the paper feeding unit, the developing unit, and the fixing unit under various conditions, a torque margin needs to be secured by using a motor having a high torque. Increasing only torque increases cost and noise, and the driving motor may have a proper torque margin at a normal temperature and under normal conditions. However, it is difficult to secure a proper torque margin since a load is increased at a low temperature. If a torque margin is inappropriate, a defect may be generated in the driving motor. A method of securing a torque margin by simply adjusting a driving time of the driving motor may be considered. However, in such method, it is difficult to predict a time to drive the driving motor such that a time to drive a photoreceptor of the developing unit may be extended, thereby affecting a lifespan of the developing unit. Also, if a torque margin is not secured due to environmental factors, printing may not be performed due to a recording medium being jammed or the driving motor being stalled.

SUMMARY

Exemplary embodiments of the present general inventive concept provide an image forming apparatus that may be safely driven under a low temperature environment in which a driving load is increased, and a method of driving the image forming apparatus.

Additional features and utilities of the present general inventive concept will be set forth in part in the description which follows and, in part, will be obvious from the description, or may be learned by practice of the general inventive concept.

Exemplary embodiments provide a method of driving an image forming apparatus, the image forming apparatus including an image forming unit to transfer and fix an image on a recording medium and a driving motor to drive the image forming unit, the method including: detecting a driving environment including a temperature; if the driving environment is a low temperature environment, decreasing a driving load of the image forming unit by repeating driving and stopping the driving motor, the driving being under a high load driving condition to generate a torque higher than a torque generated under a normal warm-up driving condition; and performing a warm-up operation by driving the driving motor under the normal warm-up driving condition.

A method may further include, if the driving motor is not maintained at a high load driving speed determined by the high load driving condition for a maintaining time, stopping the driving motor and then re-driving the driving motor under the high load driving condition; if the driving motor is maintained at the high load driving speed for the maintaining time, stopping the driving motor and then re-driving the driving motor under the high load driving condition; and when a number of times of the driving motor being maintained at the high load driving speed for the maintaining time reaches a number of continuous successes, performing the warm-up operation.

In exemplary embodiments, the method may further include, if a number of the re-driving operations reaches a maximum number of re-driving operations, displaying a driving error.

In exemplary embodiments, the method may further include starting preheating of a fixing unit for fixing an image on the recording medium, at a time that is not later than a time when driving of the driving motor starts under the high load driving condition.

In exemplary embodiments, the method may further include, counting the preheating time; and if the preheating time reaches a maximum preheating time, stopping the preheating.

In exemplary embodiments, the method may further include, if the driving motor fails to be driven under the high load driving condition, preheating the fixing unit for the maximum preheating time and then re-driving the driving motor under the high load driving condition.

Exemplary embodiments provide an image forming apparatus including: an image forming unit to transfer and fix an image on a recording medium; a driving motor to drive the image forming unit; an environment recognizing unit to detect a driving environment, the driving environment including a temperature; and a controller to control the image forming unit and the driving motor so as to decrease a driving load of the image forming unit by repeating driving and stopping the driving motor under a high load driving condition to generate a torque higher than a torque generated under a normal warm-up driving condition and to perform a warm-up operation by driving the driving motor under the normal warm-up driving condition.

In exemplary embodiments, the image forming apparatus may further include a speed detecting unit to detect a driving speed of the driving motor, wherein if the driving motor is not maintained at a high load driving speed determined by the high load driving condition for a maintaining time and if a number of times of the driving motor being maintained at the high load driving speed for the maintaining time has not reached a number of continuous successes, the controller may stop the driving motor and then re-drives the driving motor under the high load driving condition.

In exemplary embodiments, the controller may control the image forming unit and the driving motor so that the driving motor performs the warm-up operation if the number of times of the driving motor being maintained at the high load driving speed for the maintaining time reaches the number of continuous successes.

In exemplary embodiments, the controller may generate a driving error signal if a number of the re-drivings reaches a maximum number of re-driving operations.

In exemplary embodiments, the image forming unit may further include a fixing unit to fix an image on the recording medium, and wherein the controller controls the heating member to start preheating of the fixing unit at a time that is not later than a time of the starting of the driving of the driving motor under the high load driving condition.

In exemplary embodiments, the controller may control the heating member to stop the preheating if a preheating time reaches a maximum preheating time.

In exemplary embodiments, the controller, if the driving motor fails to be driven under the high load driving condition, may control the heating member and the driving motor to preheat the fixing unit for the maximum preheating time and then to re-drive the driving motor under the high load driving condition.

In exemplary embodiments, the fixing unit may include a nip forming member, a pressure roller biased toward the nip forming member, and a fixing belt at least partially disposed between the nip forming member and the pressure roller, the fixing belt moving between the nip forming member and the pressure roller according to rotation of the pressure roller.

Exemplary embodiments provide a method of driving an image forming apparatus, the method including detecting a driving environment including a temperature; if the driving environment is a low temperature environment, driving the driving motor under a high load driving condition to generate a torque higher than a torque generated under a normal warm-up driving condition; and determining whether a high load driving speed of the high load driving condition is maintained for a maintaining time.

Exemplary embodiments provide an image forming apparatus including: an image forming unit to transfer and fix an image on a recording medium; a driving motor to drive the image forming unit; an environment recognizing unit to detect a driving environment, the driving environment including a temperature; and a controller to drive the driving motor under a high load driving condition to generate a torque higher than a torque generated under a normal warm-up driving condition and to determine whether a high load driving speed of the high load driving condition is maintained for a maintaining time.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE ILLUSTRATED EMBODIMENTS

Figure 1:
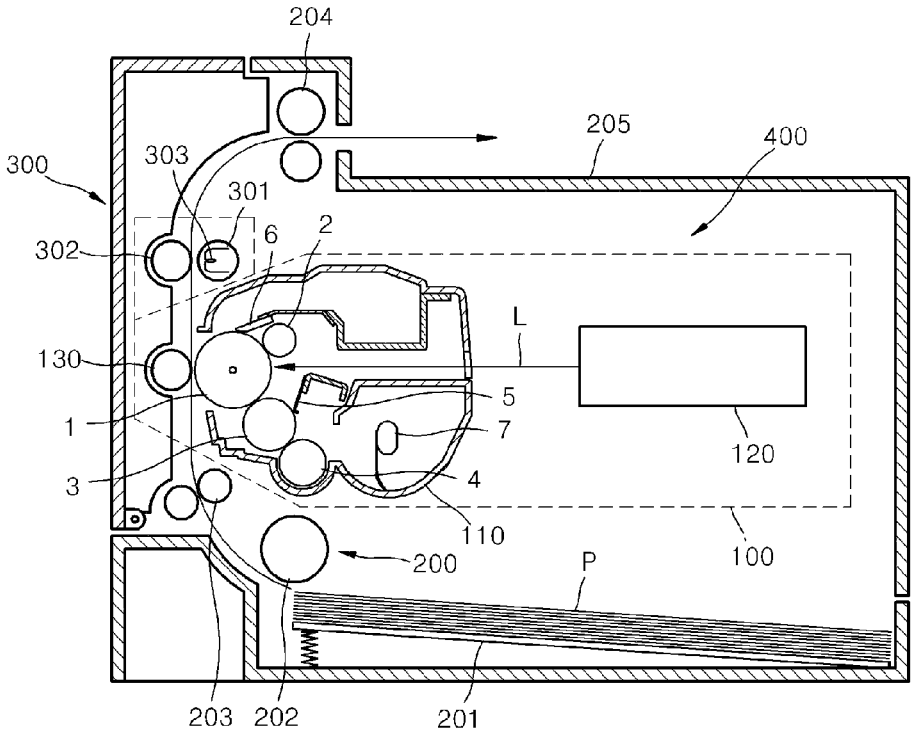
FIG. 1 is a view illustrating an electrophotographic image forming apparatus according to exemplary embodiments of the present general inventive concept.

Reference will now be made in detail to exemplary embodiments of the present general inventive concept, examples of which are illustrated in the accompanying drawings, wherein like reference numerals refer to the like elements throughout. Exemplary embodiments are described below in order to explain the present general inventive concept while referring to the figures.

FIG. 1 is a view illustrating an electrophotographic image forming apparatus according to exemplary embodiments of the present general inventive concept. The image forming apparatus may be a monochromatic electrophotographic image forming apparatus employing a dry mono-component toner. Referring to FIG. 1, an image forming unit 400 to form an image on a recording medium P includes a developing unit 100, a paper feeding unit 200, and a fixing unit 300.

The paper feeding unit 200 picks up the recording medium P on which an image is to be printed from a paper feeding cassette 201 and discharges the recording medium P after an image is printed thereon to a discharge tray 205 via the developing unit 100 and the fixing unit 300. The paper feeding unit 200 may include a pickup roller 202 to take out the recording medium P from the paper feeding cassette 201, a feed roller 203 to feed the recording medium P taken out from the paper feeding cassette 201 to the developing unit 100 and the fixing unit 300, and a discharging roller 204 to discharge the recording medium P having passed through the fixing unit 300 to the discharge tray 205. Although not shown in FIG. 1, a registration roller to align the recording medium P may further be included between the pickup roller 202 and the feed roller 203.

The developing unit 100 transfers a toner image formed by an electrophotographic process on the recording medium P. The developing unit 100 may include a photoreceptor drum 1, an electrostatic charging roller 2, an exposing device 120, a developing device 110, and a transfer roller 130. The photoreceptor drum 1 is a photoreceptor on which a latent image is formed, and includes a photosensitive layer having photoconductivity and formed on an outer circumferential surface of a cylindrical metal pipe. The electrostatic charging roller 2 is a charger to charge a surface of the photoreceptor drum 1 to a uniform potential. A charging bias voltage is applied to the charging roller 2. A corona charger (not shown) may be used instead of the charging roller 2.

The exposing device 120 forms an electrostatic latent image by scanning light L modulated according to image information onto the surface of the photoreceptor drum 1 charged to a uniform potential. The exposing device 120 may be, for example, a laser scanning unit (LSU) that deflects light radiated from a laser diode in a main scanning direction by using a polygonal mirror and scans the light onto the photoreceptor drum 1.

The developing device 110 supplies a toner to the electrostatic latent image formed on the photoreceptor drum 1 to develop the electrostatic latent image. The developing device 110 accommodates a toner. A developer roller 3 is used to develop the electrostatic latent image formed on the photoreceptor drum 1 by supplying a toner to the electrostatic latent image. A non-contact developing method may be used, and a surface of the developer roller 3 and the surface of the photoreceptor drum 1 may be spaced apart to have a developing gap of about several hundred μm. If a developing bias voltage is applied to the developer roller 3, a toner is moved and attached to the electrostatic latent image formed on the surface of the photoreceptor drum 1 through the developing gap. However, aspects need not be limited thereto such that a contact developing method may be used, and the developer roller 3 may contact the photoreceptor drum 1.

The developing device 100 may further include a supply roller 4 to attach a toner to the developer roller 3. A supply bias voltage may be applied to the supply roller 4 in order to attach a toner to the developer roller 3. A regulation member 5 regulates an amount of toner attached to the surface of the developer roller 3. The regulation member 5 may be, for example, a regulation blade of which an end contacts the developer roller 3 with a determined pressure. A cleaning member 6 removes a residual toner and foreign substances from the surface of the photoreceptor drum 1 before a charging operation is performed. The cleaning member 6 may be, for example, a cleaning blade of which an end contacts the surface of the photoreceptor drum 1. An agitator 7 transfers a toner to the developer roller 3. The agitator 7 may also stir a toner and charge the toner to a determined potential. Although FIG. 1 illustrates only one agitator 7, the present general inventive concept is not limited thereto, and any appropriate number of agitators 7 may be disposed in appropriate positions in order to effectively supply a toner to the developer roller 3 in consideration of a capacity or a shape of the developing device 110. The agitator 7 may have a shape in which one or more flexible agitating blades having a film shape are formed on a rotation axis thereof. Although not shown in FIG. 1, the agitator 7 may be an auger including a spiral agitating blade.

The transfer roller 130 is a transfer device that is disposed to face the surface of the photoreceptor drum 1 and forms a transfer nip with the photoreceptor drum 1. A transfer bias voltage is applied to the transfer roller 130 to transfer a toner image developed on the surface of the photoreceptor drum 1 on the recording medium P. However, aspects need not be limited thereto such that the transfer roller 130 may be replaced with a corona transfer device.

The toner image transferred on a surface of the recording medium P by the transfer roller 130 is maintained on the surface of the recording medium P by an electrostatic attraction. The fixing unit 300 applies heat and pressure to the toner image to fix the toner image on the recording medium P, and thus an image is printed on the recording medium P.

Figure 2:
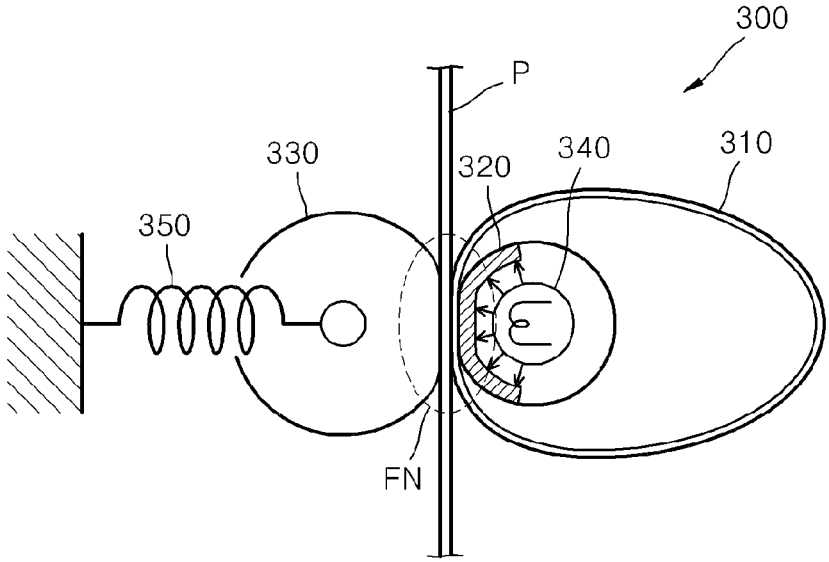
FIG. 2 is a view illustrating a fixing unit according to exemplary embodiments of the present general inventive concept.

The fixing unit 300, as illustrated in FIG. 1, may have a shape in which a heating roller 301 having a heating member 303 disposed therein is engaged with a pressure roller 302 to form a fixing nip. The fixing unit 300 may be a belt-type fixing unit as illustrated in FIG. 2. FIG. 2 is a view illustrating a fixing unit according to exemplary embodiments of the present general inventive concept. Referring to FIG. 2, the fixing unit 300 includes a fixing belt 310, a nip forming member 320, a pressure roller 330, and a heating member 340. The nip forming member 320 is disposed inside the fixing belt 310, which has a closed-loop shape. The pressure roller 330 is disposed outside of the fixing belt 310. In order to form a fixing nip FN, the pressure roller 330 is pressed toward the nip forming member 320 with the fixing belt 310 disposed between the pressure roller 330 and the nip forming member 320. An elastic member 350 provides to the pressure roller 330 a compression force directed toward the nip forming member 320. Although not shown in FIG. 2, the fixing belt 310 may have a closed-loop shape in which an elastic layer and a release layer are formed on a flexible substrate formed of, for example, a metal thin film. A black coating layer for easily absorbing radiant heat of the heating member 340 may be formed inside the flexible substrate. The heating member 340 may be any of variously shaped heating members, for example, a heating lamp, such as a halogen lamp, an induction heater, or the like. A temperature of the fixing belt 310 increases by being directly heated through the heating member 340 and being indirectly heated through the nip forming member 320 having absorbed thermal energy of the heating member 340. When the recording medium P onto which the toner image is attached passes through the fixing nip FN, the toner image is fused due to the thermal energy, and the fused toner image is compressed and fixed on the surface of the recording medium P due to a pressure applied by the nip forming member 320 and the pressure roller 330.

In FIG. 1, the photoreceptor drum 1 and the electrostatic charging roller 2 are accommodated in the developing device 110, but the present general inventive concept is not limited thereto, and the photoreceptor drum 1 and the charging roller 2 may be formed outside of the developing device 110 so that the photoreceptor drum 1 and the charging roller 2 may be attached to and detached from the image forming apparatus separate from the developing device 110.

Figure 3:
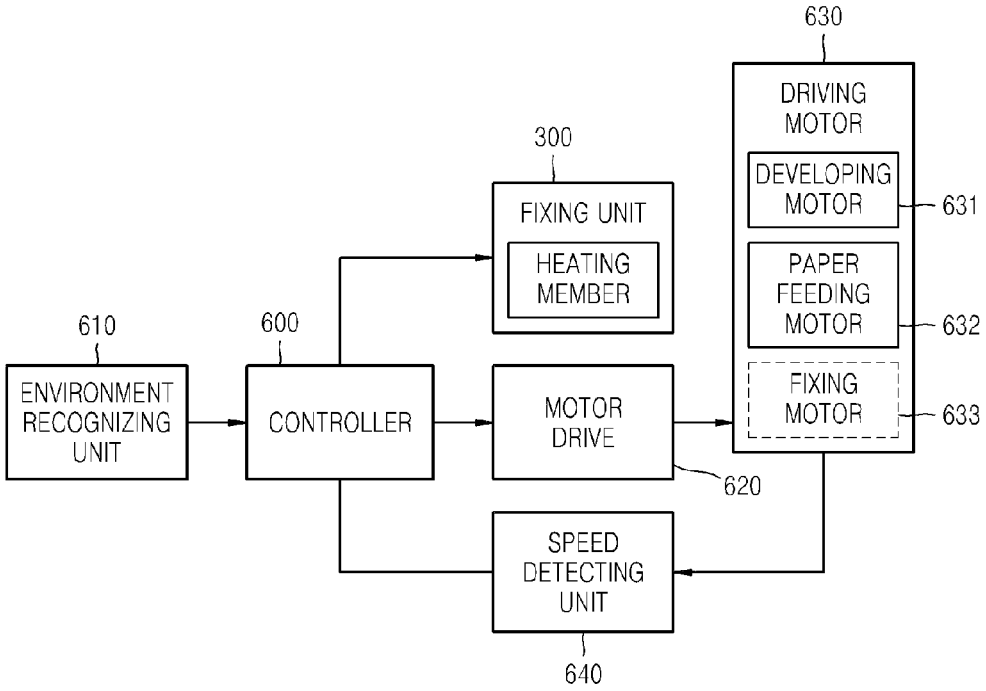
FIG. 3 is a block diagram illustrating an image forming apparatus according to exemplary embodiments of the present general inventive concept.

FIG. 3 is a block diagram illustrating an image forming apparatus according to exemplary embodiments of the present general inventive concept. Referring to FIG. 3, the image forming apparatus includes one or more driving motors 630 to drive the image forming unit 400. The driving motor 630 may include a developing motor 631 to drive components of the developing unit 100, for example, the photoreceptor drum 1, the charging roller 2, the developer roller 3, the supply roller 4, the agitator 7, the transfer roller 130, etc., and a paper feeding motor 632 to drive the paper feeding unit 200 and the fixing unit 300. The fixing unit 300 may be driven separately from the paper feeding unit 200 by a fixing motor 633. A controller 600 controls the driving motor 630 through a motor drive 620 and may include one or more processors. A driving state, for example, a driving speed of the driving motor 630, may be detected by a speed detecting unit 640 and may be fed back to the controller 600. The speed detecting unit 640 may be configured by, for example, an encoder (not shown) to measure a number of rotations of the driving motor 630. The speed detecting unit 640 may be configured by a circuit to detect a driving voltage that is determined according to a current supplied to the driving motor 630 and according to an internal resistance of the driving motor 630. However, the speed detecting unit 640 may be configured in various other ways. The driving motor 630 may be, for example, a direct current (DC) motor, a DC brushless motor, a stepping motor, or the like.

The controller 600 controls the heating members 303 and 340 of the fixing unit 300 to maintain the fixing unit 300 at a determined temperature. Although not shown in FIG. 3, the fixing unit 300 may include a temperature detecting member to detect an internal temperature of the fixing unit 300, a thermistor to prevent the fixing unit 300 from being overheated, and the like.

An environment recognizing unit 610 detects a usage environment of the image forming apparatus, for example, a temperature of the image forming apparatus. The environment recognizing unit 610 may include an internal temperature sensor (not shown) disposed inside the image forming apparatus to measure an internal temperature of the image forming apparatus. The environment recognizing unit 610 may further include an external temperature sensor (not shown) to measure an external temperature of the image forming apparatus. However, aspects need not be limited thereto such that the internal temperature of the image forming apparatus may be detected by using an indirect method. For example, resistance values of the charging roller 2, the developer roller 3, and the transfer roller 130 change according to temperature, and thus the internal temperature of the image forming apparatus may be detected by applying a determined reference current to the charging roller 2, the developer roller 3, and/or the transfer roller 130 and measuring a resistance of the charging roller 2, the developer roller 3, and/or the transfer roller 130. The environment recognizing unit 610 may further include a humidity sensor (not shown). A value detected by the environment recognizing unit 610 is transferred to the controller 600. The controller 600 determines an operating environment of the image forming apparatus based on the value detected by the environment recognizing unit 610 and performs a warm-up operation to be described later based on the determined operating environment.

The image forming apparatus performs a preliminary operation, before performing a printing operation, to check whether the image forming unit 400 is normally operated and to allow the image forming unit 400 to be in a proper state for performing the printing operation, and the preliminary operation may be referred to as a warm-up operation. The warm-up operation may include, for example, an operation for checking whether each driving element of the image forming unit 400 is normally operated, an operation for preheating the fixing unit 300 to a temperature that is appropriate for the printing operation, and the like.

The image forming apparatus may be used under various environments. At a low temperature, viscosity of a lubricant coated on a power transmission device, such as a gear to connect the driving motor 630 with the paper feeding unit 200, the developing unit 100, and the fixing unit 300, may be increased, thereby increasing a driving load of the image forming apparatus. Also, when the image forming apparatus is left at a low temperature, a toner accommodated in the developing device 110 may lump, thereby increasing a rotational load of the agitator 7. In the belt-type fixing unit 300 illustrated in FIG. 2, a lubricant is coated on an internal surface of the fixing belt 310 to decrease a frictional force with respect to the nip forming member 320, and thus viscosity of the lubricant is increased at a low temperature, thereby increasing a running resistance of the fixing belt 310. As such, a driving load of the image forming unit 400 is greatly increased at a low temperature. Accordingly, when a warm-up operation is performed at a low temperature, if the driving motor 630 is immediately driven under a normal warm-up driving condition, the driving motor 630 may not rotate at a normal speed or may not rotate at all.

According to the method of driving the image forming apparatus, when the image forming apparatus is driven at a low temperature, a driving load of the image forming unit 400 may be decreased in order for the driving motor 630 to be safely driven under the normal warm-up driving condition before performing a normal warm-up operation.

Figure 4:
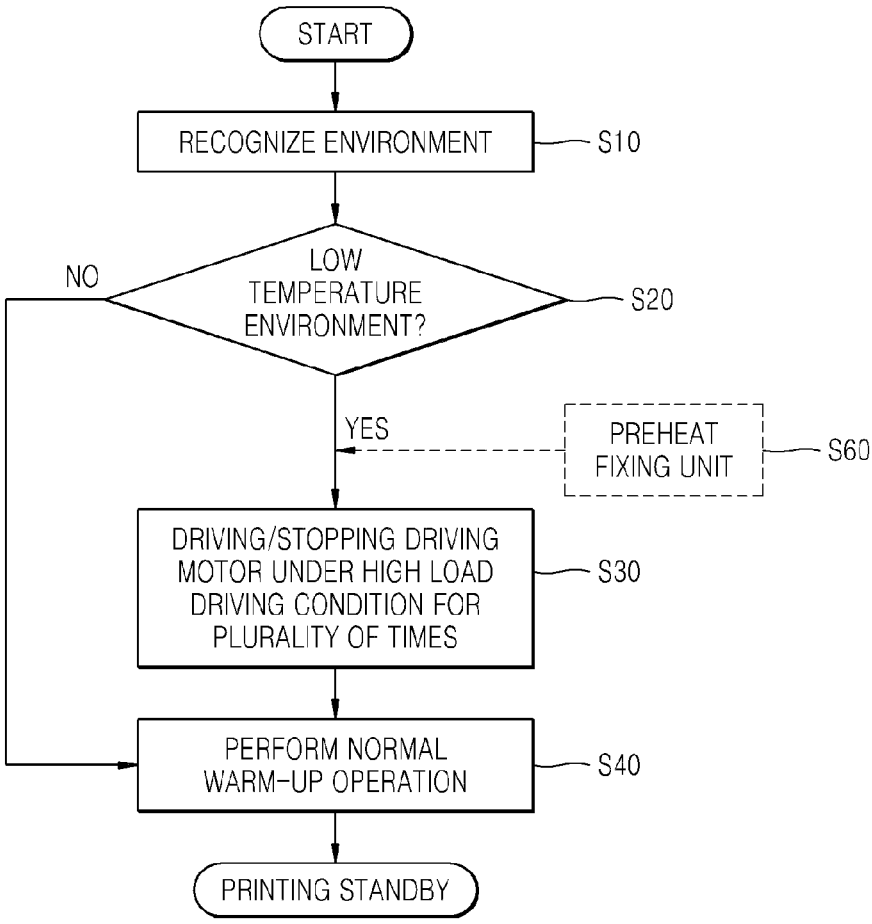
FIG. 4 is a flowchart illustrating a method of driving an image forming apparatus according to exemplary embodiments of the present general inventive concept.

FIG. 4 is a flowchart illustrating a method of driving the image forming apparatus according to exemplary embodiments of the present general inventive concept. If a power source of the image forming apparatus is changed from an OFF state to an ON state or if a printing command is input from an external host device (not shown), for example, a computer, while the power source of the image forming apparatus is in a standby state from being maintained in the ON state, driving of the image forming apparatus starts.

First, the environment recognizing unit 610 detects a driving environment of the image forming apparatus and transmits a value corresponding to the detected environment to the controller 600 (S10). The controller 600 determines whether the driving environment is a low temperature environment by comparing a temperature according to a detected value with a determined reference temperature (S20). The reference temperature may be properly set by considering a torque margin of the driving motor 630 employed in the image forming apparatus, a physical property of a lubricant, and the like. The reference temperature may be set to be, for example, about 5° C., about 0° C., or the like.

If the driving environment is not a low temperature environment, a warm-up operation is performed by driving the driving motor 630 under a normal warm-up driving condition (S40).

If the driving environment is a low temperature environment, the driving motor 630 is driven under a high load driving condition where the driving motor 630 may output a torque greater than that under the normal warm-up driving condition in order to secure a sufficient torque margin (S30). The torque margin is a difference between a driving torque of the driving motor 630 and a driving load of the image forming unit 400. In general, a torque of the driving motor 630 is increased as a driving speed thereof is decreased. Accordingly, in the high load driving condition, the driving motor 630 may be driven at a speed lower than a driving speed at which the driving motor 630 is driven under the normal warm-up driving condition. Also, if a supply of current for driving the driving motor 630 is increased, a torque of the driving motor 630 is increased, and thus the controller 600 may control the driving motor 630 by applying to the driving motor 630 an amount of current greater than that applied to the driving motor 630 under the normal warm-up driving condition. Accordingly, a torque margin is secured so that the driving motor 630 may normally rotate even when a driving load of the image forming unit 400 is great.

In general, a load torque of a motor is greatest when the motor starts operating, and after the motor has started to rotate, the load torque of the motor is decreased. Even if the motor had successfully started to operate, and even if the motor had been driven at a constant high load driving speed under the high load driving condition for a period of time, the motor may fail to operate or may not be driven constantly at the high load driving speed if the motor had stopped operating and then starts operating again. According to a method of driving the image forming apparatus, a driving operation and a stopping operation of the driving motor 630 are repeated for a plurality of times. If the driving motor 630 rotates, the paper feeding unit 200, the developing unit 100, and the fixing unit 300 operate. Then, viscosity of a lubricant having had a high viscosity at a low temperature is gradually decreased, and a lumped toner is ground or dispersed, thereby decreasing a driving load of the image forming unit 400. Thus, the driving load of the image forming unit 400 may be decreased up to a state where the driving motor 630 may be driven under the normal warm-up driving condition. A number of repeated driving and stopping operations of the driving motor 630 may be determined according to conditions, for example, detected temperatures. Then, the driving motor 630 is driven under the normal warm-up driving condition and the warm-up operation of the driving motor 630 is performed (S40).

As described above, a driving operation and a stopping operation of the driving motor 630 are repeated a plurality of times under a condition where the driving motor 630 may show a high torque at a low temperature so as to decrease a driving load of the image forming unit 400, and then a warm-up operation of the driving motor 630 is performed. Accordingly, operational defects, such as the driving motor 630 being stalled or a recording medium being jammed, are decreased even at a low temperature, and normal warm-up and printing operations may be performed.

Figure 5:
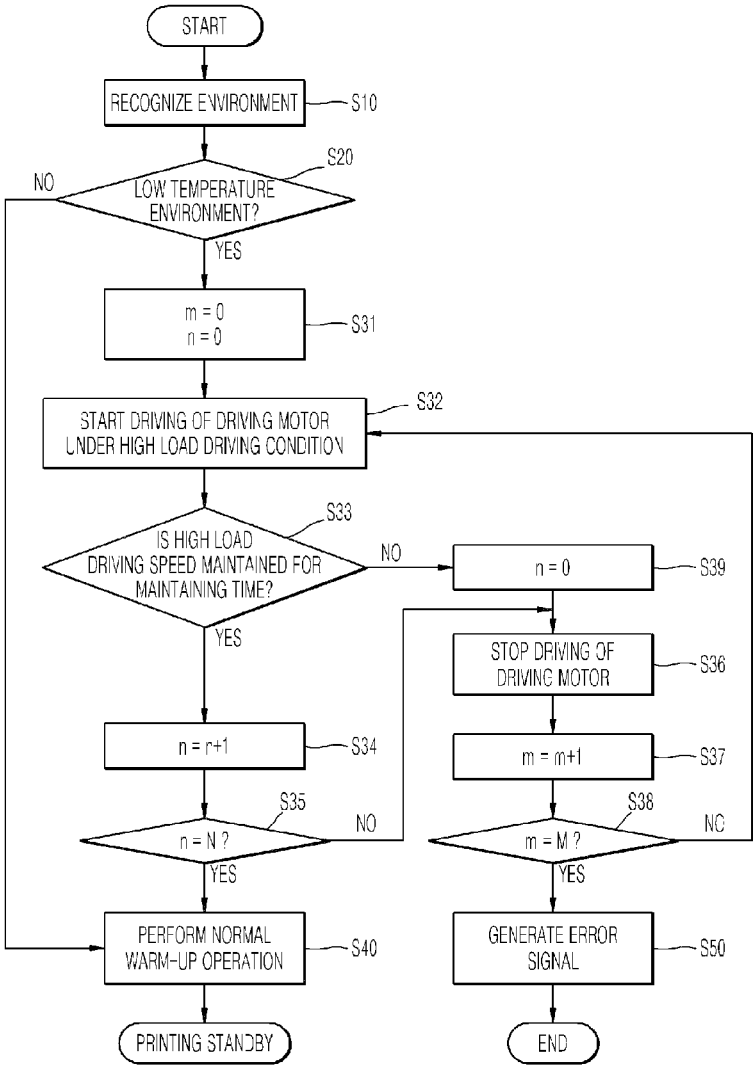
FIG. 5 is a flowchart illustrating a method of driving the image forming apparatus according to exemplary embodiments of the present general inventive concept.

Operation (S30) to drive the driving motor 630 under an initial driving condition at a low temperature will be described in detail with reference to FIG. 5. FIG. 5 is a flowchart illustrating a method of driving the image forming apparatus according to exemplary embodiments of the present general inventive concept. If it is determined that the driving environment is a low temperature environment (S20), the controller 600 sets a re-driving count m and a continuous driving count n to "0" (S31). The re-driving count m denotes a number of re-driving operations performed after stopping the driving motor 630, and the continuous driving count n denotes a number of successes in maintaining the driving motor 630 at the high load driving speed for a determined maintaining time.

The controller 600 sets a driving condition of the driving motor 630 to the high load driving condition, and starts driving of the driving motor by controlling the motor drive 620 (S32).

The speed detecting unit 640 detects whether the driving motor 630 has reached the high load driving speed and whether the driving motor 630 is maintained at the high load driving speed for the determined maintaining time (S33), and transmits a result of the detection to the controller 600. The determined maintaining time may be set, and the maintaining time may be set to be, for example, about 10 seconds.

If the driving motor 630 is maintained at the high load driving speed for the determined maintaining time, the controller 600 increases the continuous driving count n by "1" (S34) and determines whether the continuous driving count n has reached a number of continuous successes N. The number of continuous successes N may be determined according to conditions or preset. For example, if the determined maintaining time is set to be about 10 seconds, the number of continuous successes N may be set to be about 5 times.

If the continuous driving count n reaches the number of continuous successes N, a driving load of the image forming unit 400 is sufficiently decreased, and the controller 600 drives the driving motor 630 under the normal warm-up driving condition and performs the warm-up operation (S40).

In operation (S33), if the driving motor 630 is not maintained at the high load driving speed for the determined maintaining time, the controller 600 resets the continuous driving count n to "0" (S39) and stops the driving motor 630 (S36). In operation (S35), if the continuous driving count n has not reached the number of continuous successes N, the controller 600 stops the driving motor 630 (S36).

A process of re-driving the driving motor 630 under the high load driving condition is performed. First, the re-driving count m is increased by "1" (S37), and the controller determines whether the re-driving count m has reached a maximum number of re-driving operations M that is previously set (S38). The maximum number of re-driving operations M may be determined according to conditions or preset. For example, if the determined maintaining time is set to be about 10 seconds and if the number of continuous successes N is set to be about 5 times, the maximum number of re-driving operations M may be set to be about 50 times.

If the re-driving count m has not reached the maximum number of re-driving operations M, the controller 600 proceeds to operation (S32) and re-drives the driving motor 630 under the high load driving condition.

If the re-driving count m has reached the maximum number of re-driving operations M, the controller 600 generates an error signal representing a failure in driving the driving motor 630. The error signal represents that the image forming apparatus may not normally operate under the current usage environment. In this case, the controller 600 may control the driving motor 630 to be driven under the high load driving condition after a determined time is lapsed.

As described above, under a low temperature environment, by performing a process of controlling the driving motor 630 to be successfully driven under the high load driving condition for the number of continuous successes N before performing a normal warm-up operation, a driving load of the image forming unit 400 may be decreased to a state at which the driving motor 630 may be driven under the normal warm-up driving condition, and incidence of poor printing, such as printing failure or the recording medium P being jammed, may be decreased.

In the fixing unit 300, the heating roller 301 and the pressure roller 302 are pressed against each other or the nip forming member 320 and the pressure roller 330 are pressed against each other, and thus a driving load of the fixing unit 300 is relatively great. In particular, as illustrated in FIG. 2, the belt-type fixing unit 300 has a structure in which the fixing belt 310 and the nip forming member 320 slidably contact each other, and has a relatively great driving load. Furthermore, under a low temperature environment, a performance of the lubricant coated on the internal surface of the fixing belt 310 deteriorates, and thus the driving load of the fixing unit 300 is further great.

Figure 6:
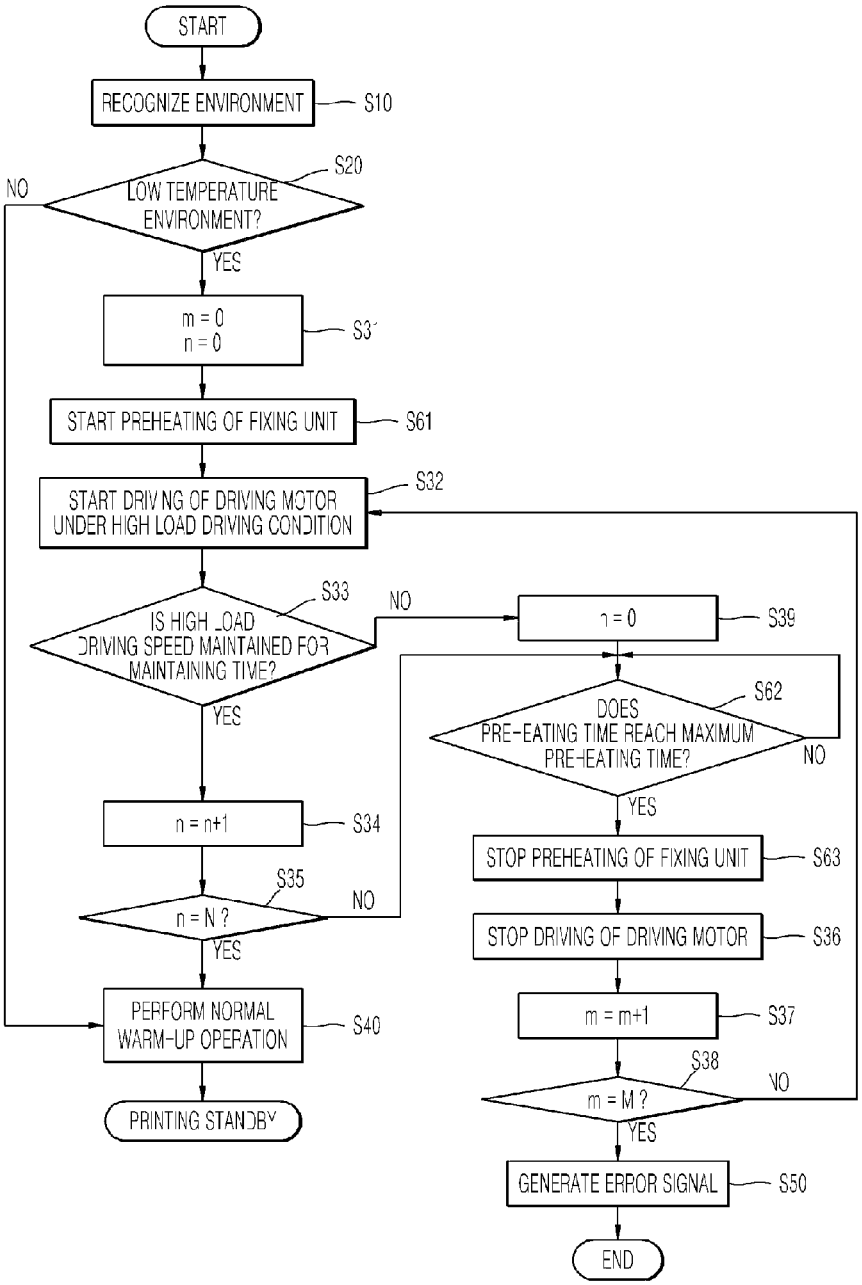
FIG. 6 is a flowchart illustrating a method of driving the image forming apparatus according to exemplary embodiments of the present general inventive concept.

FIG. 6 is a flowchart illustrating a method of driving the image forming apparatus according to exemplary embodiments of the present general inventive concept. With reference to FIG. 6, the method of driving the image forming apparatus may further include, if the driving environment is a low temperature environment, starting preheating (S61) of the fixing unit 300 by driving the heating members 303 and 340 before driving the driving motor 630 under the high load driving condition or at the same time. Thus, by restoring performances of the lubricant coated on the internal surface of the fixing belt 310 and the lubricant coated on the power transmission device, such as a gear for driving the fixing unit 300, a driving load of the image forming unit 400 may be decreased to enable the driving motor 630 to be driven under the normal warm-up driving condition.

The preheating of the fixing unit 300 may continue while the driving and stopping operations of the driving motor 630 are repeated under the high load driving condition a plurality of times. However, if the preheating of the fixing unit 300 continues when the driving motor 630 is not normally driven, the fixing unit 300 may be locally overheated. In particular, in the fixing unit 300 illustrated in FIG. 2, if the fixing belt 310 does not rotate or rotates slowly, a portion of the fixing belt 310 located in the fixing nip FN may be overheated, thereby damaging the fixing belt 310. Accordingly, the controller 600 may limit a preheating time of the fixing unit 300 to be less than or equal to a maximum preheating time. The maximum preheating time may be determined according to a material and a structure of the fixing belt 310, a structure of the fixing unit 300, and a type of lubricant, and may be set to be, for example, about 10 seconds.

The preheating (S61) of the fixing unit 300 will be described in detail with reference to FIG. 6. The controller 600 starts preheating the fixing unit 300 before or at the same time that driving of the driving motor 630 starts under the high load driving condition. The controller 600 may control the heating members 303 and 340, as long as the preheating time does not reach or exceed the maximum preheating time, so as to continue preheating of the fixing unit 300 even while the driving motor 630 is driven under the high load driving condition. For example, if the driving motor 630 is not maintained at the high load driving speed for the determined maintaining time or if the driving motor 630 fails to be continuously driven under the high load driving condition for the number of continuous successes N, the preheating of the fixing unit 300 continues until the preheating time of the fixing unit 300 reaches the maximum preheating time (S62). If the preheating time of the fixing unit 300 reaches the maximum preheating time, the preheating of the fixing unit 300 is stopped (S63), and operating of the driving motor 630 is stopped (S36), and then the driving motor 630 is re-driven under the high load driving condition (S32). Although not shown in FIG. 6, operations (S62) and (S63) may be performed after operation (S36), that is, between operations (S36) and (S32). Thus, a possibility that driving of the driving motor 630 succeeds in the re-driving of the driving motor 630 may be increased. Also not shown in FIG. 6, if the driving motor 630 fails to be continuously driven under the high load driving condition for the number of continuous successes N, operating of the driving motor 630 is stopped (S36) without determining whether the maximum preheating time of the fixing unit 300 is reached. Further, the operation (S62) may be performed at any time throughout the process, i.e., that the maximum preheating time of the fixing unit 300 is reached may be determined at any point throughout the process, at which time operation (S63) is performed to stop the preheating of the fixing unit 300. Moreover, the operation (S62) may be performed concurrently with any of the other operations.

Also, a period in which the driving motor 630 rotates in order to decrease the driving load of the image forming unit 400 may be decreased, thereby decreasing a number of rotations of components of the developing unit 100, for example, the photoreceptor drum 1, the developer roller 3, the charging roller 2, etc., while the components are not performing a printing operation. Accordingly, life-shortening of the image forming apparatus, which may result due to abrasion or deterioration of driving components due to unnecessary rotation, may be prevented.

A reference temperature for determining a low temperature environment may be about 5° C. or about 0° C., a time for maintaining a high load driving speed may be about 10 seconds, a number of continuous successes N may be about 5 times, a maximum number of re-driving operations M may be about 50 times, and a maximum preheating time may be about 10 seconds, but the present general inventive concept is not limited thereto. The above-described setting values may be experimentally determined according to a structure of an image forming apparatus, physical and chemical characteristics of each component, a characteristic of lubricant, the environment, and the like.

In the above-described embodiment, a monochromatic image forming apparatus including a photoreceptor drum 1 and a developing device 110 has been described, but the present general inventive concept is not limited thereto. For example, a method of driving an image forming apparatus according to another embodiment of the present general inventive concept may also be used for a color image forming apparatus employing four photoreceptor drums, respectively accommodating cyan (C), magenta (M), yellow (Y), and black (K) toners, and four developing devices.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of driving an image forming apparatus, the image forming apparatus comprising an image forming unit to transfer and fix an image on a recording medium and a driving motor to drive the image forming unit, the method comprising:

detecting a driving environment comprising a temperature;

if the driving environment is a low temperature environment, decreasing a driving load of the image forming unit by repeating driving and stopping the driving motor, the driving being under a high load driving condition to generate a torque higher than a torque generated under a normal warm-up driving condition; and performing a warm-up operation by driving the driving motor under the normal warm-up driving condition based on a determination of whether the driving motor is maintained at a high load driving speed of the high load driving condition for a maintaining time.

2. The method of claim 1, further comprising:

if the driving motor is not maintained at the high load driving speed for the maintaining time, stopping the driving motor and then re-driving the driving motor under the high load driving condition;

if the driving motor is maintained at the high load driving speed for the maintaining time, stopping the driving motor and then re-driving the driving motor under the high load driving condition; and if a number of times of the driving motor being maintained at the high load driving speed for the maintaining time reaches a number of continuous successes, performing the warm-up operation.

3. The method of claim 2, further comprising, if a number of the re-driving operations reaches a maximum number of re-driving operations, displaying a driving error.

4. The method of claim 1, further comprising starting preheating of a fixing unit for fixing an image on the recording medium, at a time that is not later than a time when driving of the driving motor starts under the high load driving condition.

5. The method of claim 4, further comprising:

counting the preheating time; and if a preheating time reaches a maximum preheating time, stopping the preheating.

6. The method of claim 4, further comprising, if the driving motor fails to be driven under the high load driving condition, preheating the fixing unit for the maximum preheating time and then re-driving the driving motor under the high load driving condition.

7. An image forming apparatus comprising:

an image forming unit to transfer and fix an image on a recording medium;

a driving motor to drive the image forming unit;

an environment recognizing unit to detect a driving environment, the driving environment comprising a temperature; and a controller to control the image forming unit and the driving motor so as to decrease a driving load of the image forming unit by repeating driving and stopping the driving motor under a high load driving condition to generate a torque higher than a torque generated under a normal warm-up driving condition and to perform a warm-up operation by driving the driving motor under the normal warm-up driving condition based on a determination of whether the driving motor is maintained at a high load driving speed of the high load driving condition for a maintaining time.

8. The image forming apparatus of claim 7, further comprising a speed detecting unit to detect a driving speed of the driving motor, wherein if the driving motor is not maintained at the high load driving speed for the maintaining time and if a number of times of the driving motor being maintained at the high load driving speed for the maintaining time has not reached a number of continuous successes, the controller stops the driving motor and then re-drives the driving motor under the high load driving condition.

9. The image forming apparatus of claim 8, wherein the controller controls the image forming unit and the driving motor so that the driving motor performs the warm-up operation if the number of times of the driving motor being maintained at the high load driving speed for the maintaining time reaches the number of continuous successes.

10. The image forming apparatus of claim 8, wherein the controller generates a driving error signal if a number of the re-drivings reaches a maximum number of re-driving operations.

11. The image forming apparatus of claim 7, wherein the image forming unit further comprises a fixing unit to fix an image on the recording medium, and wherein the controller controls a heating member to start preheating of the fixing unit at a time that is not later than a time of the starting of the driving of the driving motor under the high load driving condition.

12. The image forming apparatus of claim 11, wherein the controller controls the heating member to stop the preheating if a preheating time reaches a maximum preheating time.

13. The image forming apparatus of claim 12, wherein the controller, if the driving motor fails to be driven under the high load driving condition, controls the heating member and the driving motor to preheat the fixing unit for the maximum preheating time and then to re-drive the driving motor under the high load driving condition.

14. The image forming apparatus of claim 11, wherein the fixing unit comprises a nip forming member, a pressure roller biased toward the nip forming member, and a fixing belt at least partially disposed between the nip forming member and the pressure roller, the fixing belt moving between the nip forming member and the pressure roller according to rotation of the pressure roller.

15. A method of driving an image forming apparatus, the method comprising:

detecting a driving environment comprising a temperature;

if the driving environment is a low temperature environment, driving the driving motor under a high load driving condition to generate a torque higher than a torque generated under a normal warm-up driving condition; and determining whether a high load driving speed of the high load driving condition is maintained for a maintaining time.

16. The method of claim 15, further comprising:

if the high load driving speed of the high load driving condition is maintained for a maintaining time, incrementing a driving count;

determining if the incremented driving count equals a set number of successes; and if the driving count equals the set number of successes, performing a normal warm-up operation.

17. The method of claim 15, further comprising:

if the high load driving speed of the high load driving condition is maintained for a maintaining time, incrementing a driving count;

determining if the incremented driving count equals a set number of successes; and if the driving count does not equal the set number of successes, stopping driving of the driving motor and incrementing a re-driving count.

18. The method of claim 17, further comprising:

determining if the incremented re-driving count equals a maximum number of re-driving operations; and if the incremented re-driving count equals the maximum number of re-driving operations, generating an error signal.

19. The method of claim 17, further comprising:

determining if the incremented re-driving count equals a maximum number of re-driving operations; and if the incremented re-driving count does not equal the maximum number of re-driving operations, repeating the driving motor under the high load driving condition and the determining of the high load driving speed.

20. The method of claim 17, further comprising:

before the stopping of the driving of the driving motor, determining if a preheating time of a fixing unit reaches a maximum preheating time; and if the preheating time of the fixing unit reaches the maximum preheating time, stopping the driving of the driving motor.

21. The method of claim 15, further comprising:

if the high load driving speed of the high load driving condition is not maintained for a maintaining time, setting a driving count to equal zero and stopping the driving of the driving motor.

22. The method of claim 21, further comprising:

incrementing a re-driving count;

determining if the incremented re-driving count equals a maximum number of re-driving operations; and if the incremented re-driving count equals the maximum number of re-driving operations, generating an error signal.

23. The method of claim 21, further comprising:

incrementing a re-driving count;

determining if the incremented re-driving count equals a maximum number of re-driving operations; and if the incremented re-driving count does not equal the maximum number of re-driving operations, repeating the driving motor under the high load driving condition and the determining of the high load driving speed.

24. The method of claim 21, further comprising:

before the stopping of the driving of the driving motor, determining if a preheating time of a fixing unit reaches a maximum preheating time; and if the preheating time of the fixing unit reaches the maximum preheating time, stopping the driving of the driving motor.

25. An image forming apparatus comprising:

an image forming unit to transfer and fix an image on a recording medium;

a driving motor to drive the image forming unit;

an environment recognizing unit to detect a driving environment, the driving environment comprising a temperature; and a controller to drive the driving motor under a high load driving condition to generate a torque higher than a torque generated under a normal warm-up driving condition and to determine whether a high load driving speed of the high load driving condition is maintained for a maintaining time.

* * * * *